US006170307B1

(12) United States Patent
Feder

(10) Patent No.: US 6,170,307 B1
(45) Date of Patent: Jan. 9, 2001

(54) PICK-RESISTANT LOCK SYSTEM WITH IMPROVED CYLINDER CONSTRUCTION

(76) Inventor: George N. Feder, 206 22nd Ave., Apt. #3, Indian Rocks Beach, FL (US) 33785

( * ) Notice: Under 35 U.S.C. 154(b), the term of this patent shall be extended for 0 days.

(21) Appl. No.: 09/493,727

(22) Filed: Jan. 28, 2000

Related U.S. Application Data

(63) Continuation-in-part of application No. 09/296,693, filed on Apr. 21, 1999, now Pat. No. 6,058,752, which is a continuation-in-part of application No. 09/095,377, filed on Jun. 10, 1998, now Pat. No. 5,927,115.

(51) Int. Cl.[7] ..... E05B 15/00

(52) U.S. Cl. ..... 70/419; 70/375; 70/453; 70/423; 70/373

(58) Field of Search ..... 70/367, 373, 375, 70/417, 419, 423, 424, 453, 454

(56) References Cited

U.S. PATENT DOCUMENTS

| | | | | |
|---|---|---|---|---|
| 1,434,483 | * | 11/1922 | Coney | 70/375 X |
| 1,674,513 | * | 6/1928 | Jacobi | 70/373 |
| 1,736,685 | * | 11/1929 | Wilder | 70/375 |
| 3,210,974 | * | 10/1965 | Adler | 70/419 |
| 4,161,871 | * | 7/1979 | Ziegler | 70/423 X |
| 4,282,731 | * | 8/1981 | Taksony | 70/419 X |
| 4,638,651 | * | 1/1987 | Surko, Jr. | 70/419 X |
| 5,131,247 | * | 7/1992 | Hsu | 70/419 X |
| 5,138,856 | * | 8/1992 | Chyun | 70/419 X |
| 5,823,030 | * | 10/1998 | Theriault et al. | 70/419 |
| 5,839,305 | * | 11/1998 | Aston | 70/375 X |
| 5,927,115 | * | 7/1999 | Feder | 70/419 |
| 6,058,752 | * | 5/2000 | Feder | 70/419 |

* cited by examiner

*Primary Examiner*—Suzanne Dino Barrett

(57) ABSTRACT

Disclosed is an improved cylinder construction for use with a lock system. The cylinder services to frustrate the use of lock picking tools, such as a tensioning device. Specifically, a pair of opposing flat regions are formed at the lower end of the cylinder. Furthermore, the key way formed within the cylinder has an opened lower end. These features make a system which is completely resistant to picking by way of traditional pick tools. Furthermore, the cylinder cannot be broken by way of a screwdriver or drill.

6 Claims, 9 Drawing Sheets

FIG 3
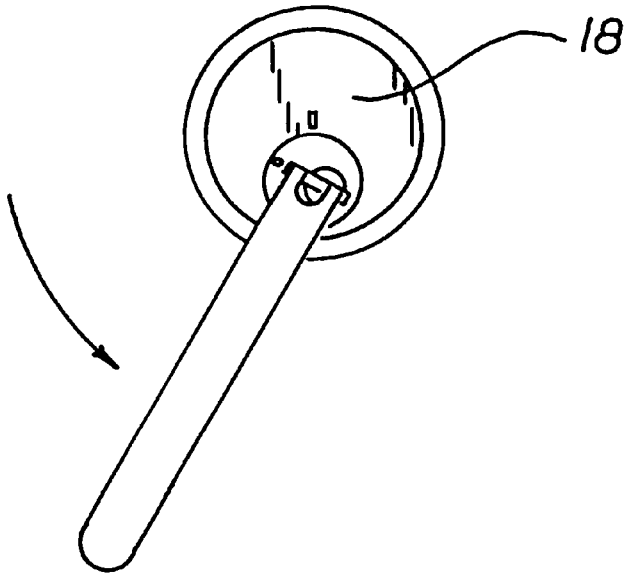
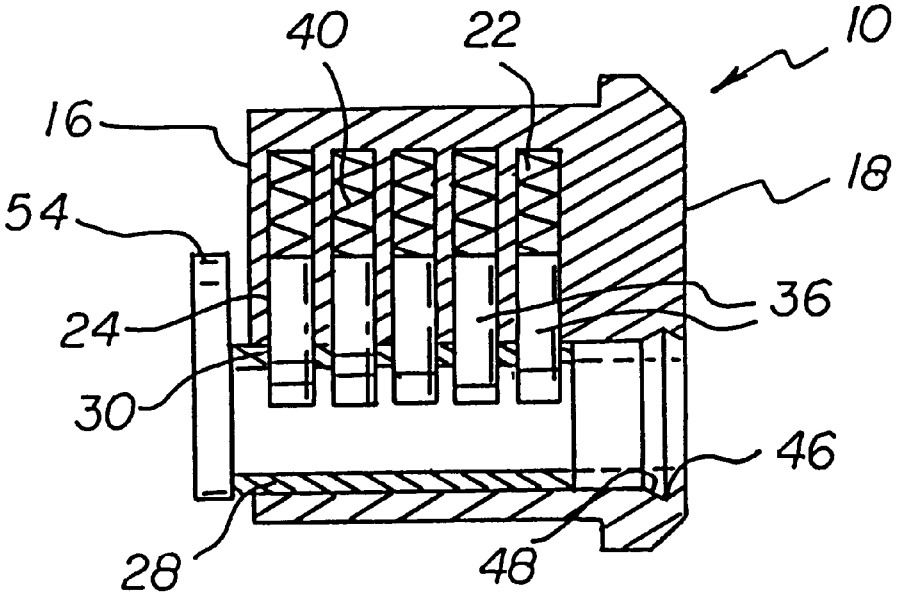
FIG 4

FIG 5
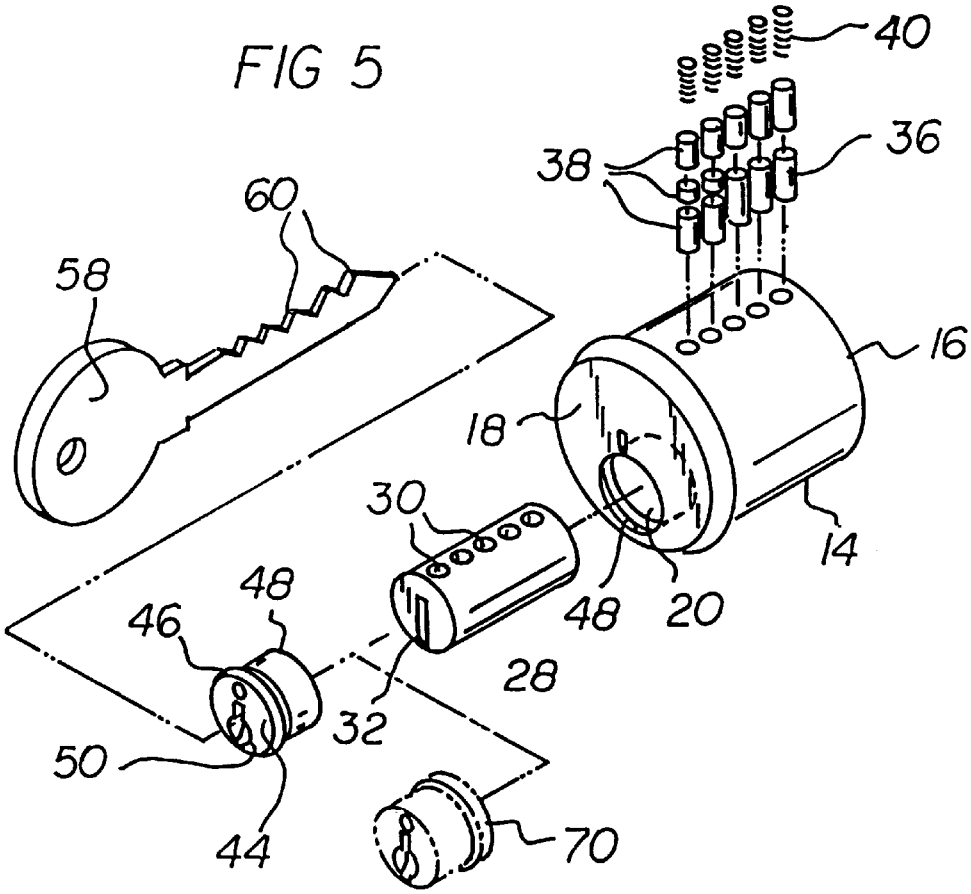
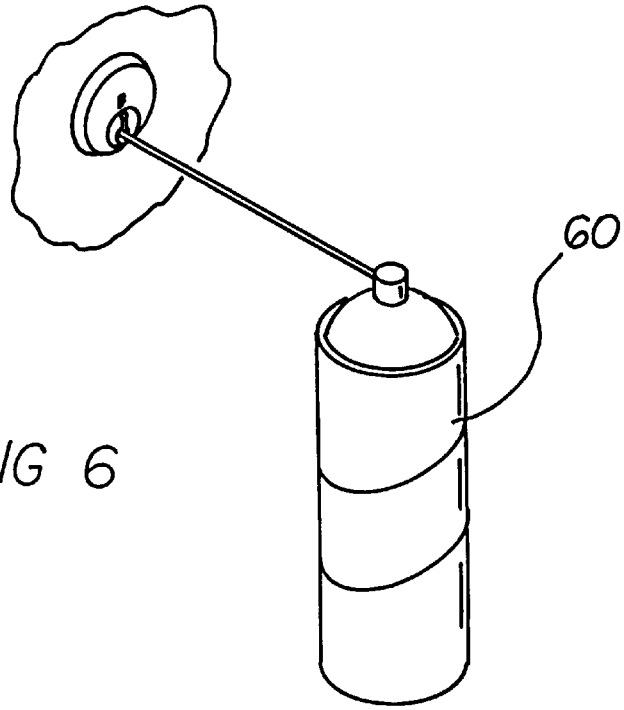
FIG 6

FIG 10
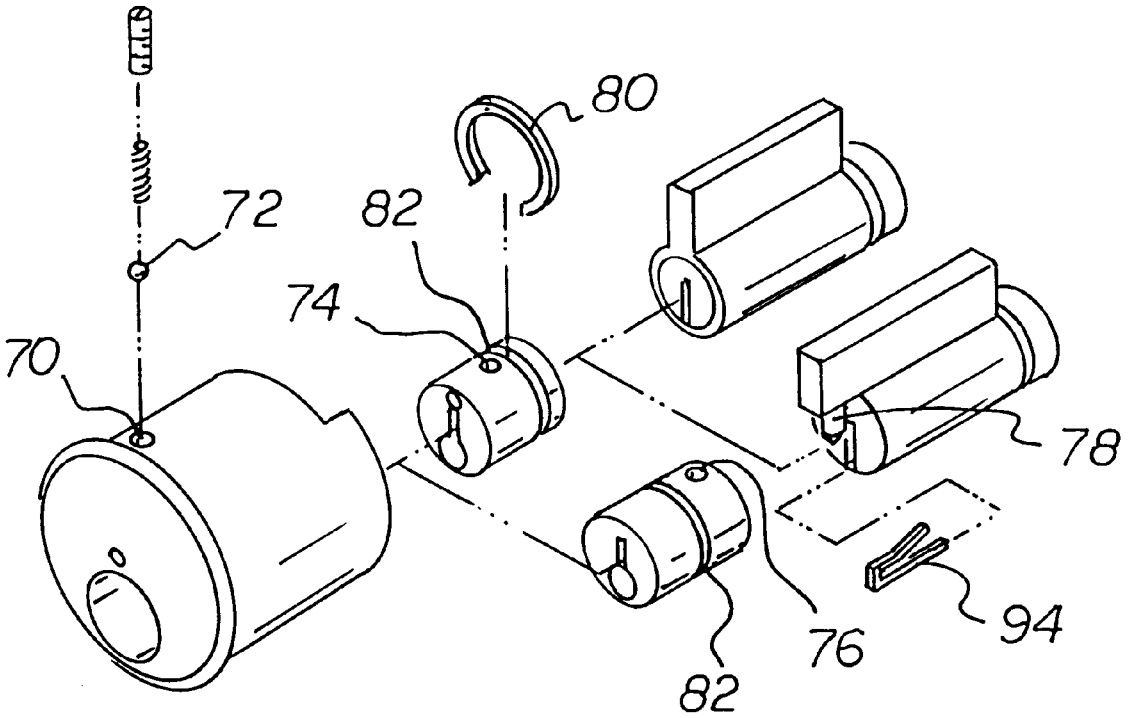
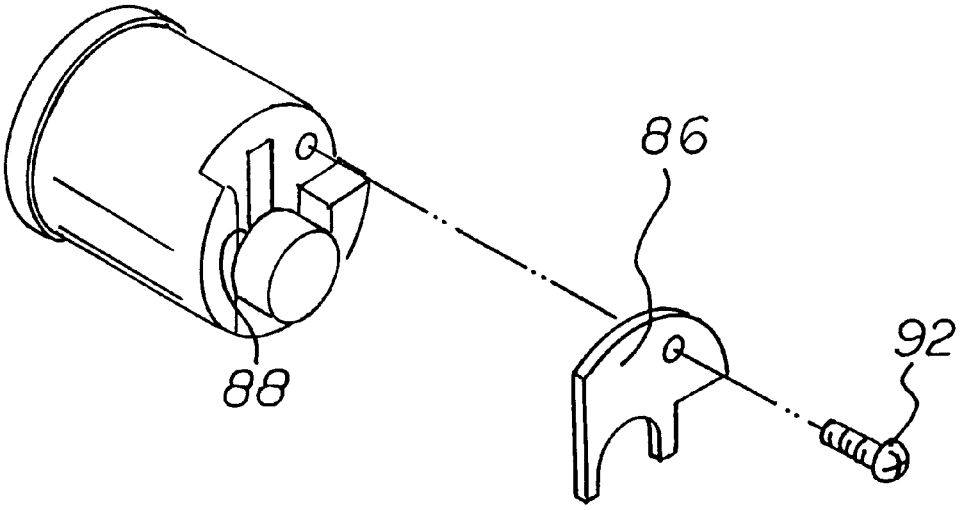
FIG 11

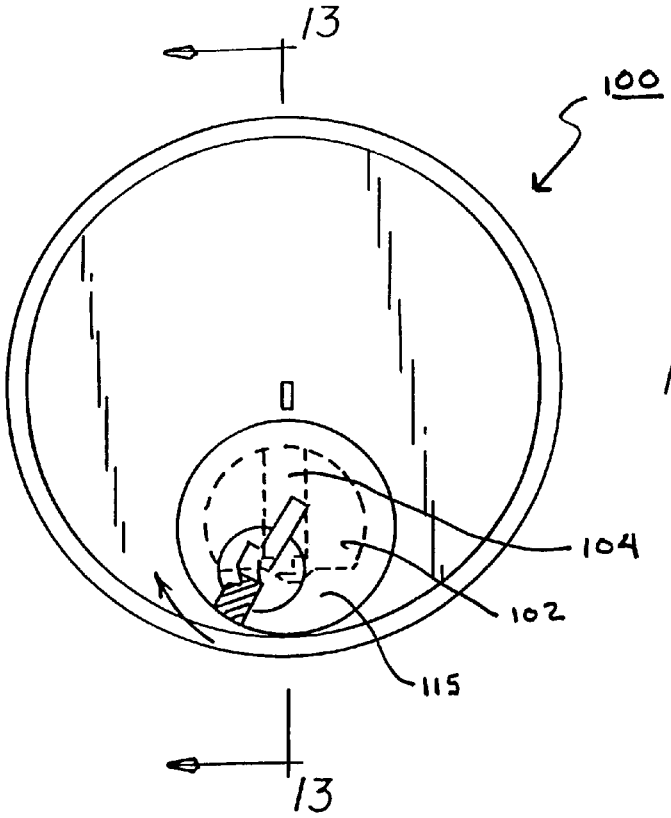
FIG 12
FIG 13
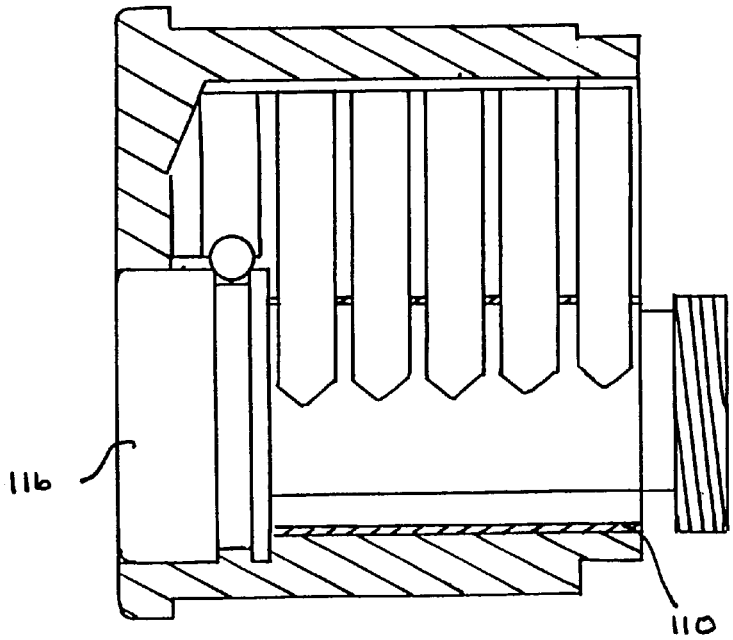

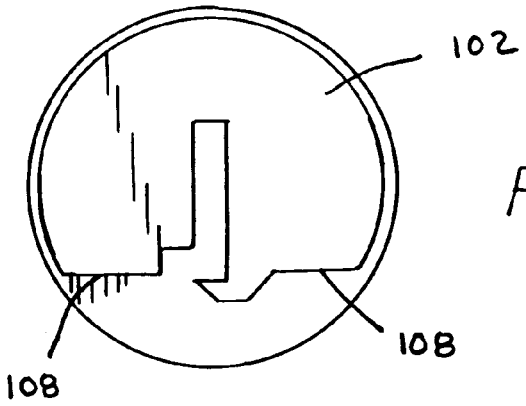
FIG 16
FIG 17
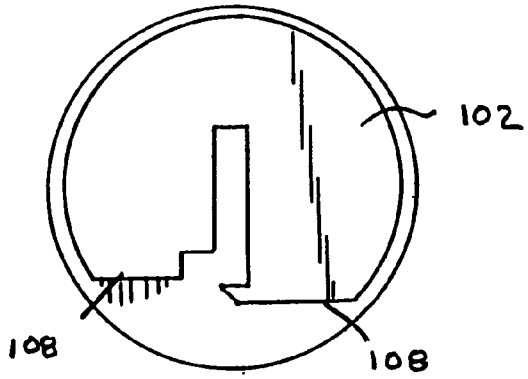
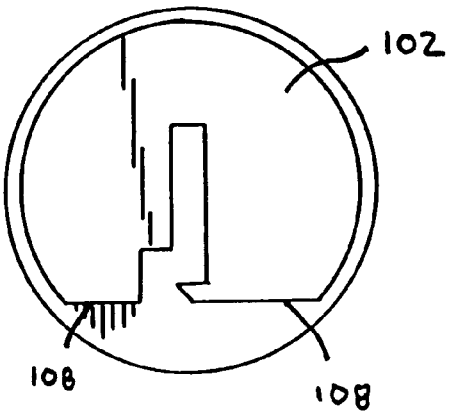
FIG 18

PICK-RESISTANT LOCK SYSTEM WITH IMPROVED CYLINDER CONSTRUCTION

RELATED APPLICATION DATA

This is a Continuation-in-Part of application Ser. No. 09/296,693, filed Apr. 21, 1999, now U.S. Pat. No. 6,058,752 entitled Pick-Resistant Lock System and Method, which is a continuation-in-part of Ser. No. 09/095,377 filed Jun. 10, 1998, now U.S. Pat. No. 5,927,115, entitled Pick-Resistant Lock System and Method, both of which are incorporated herein by reference.

BACKGROUND OF THE INVENTION

1. Field of the Invention

The present invention relates to a Pick-Resistant Lock System with Improved Cylinder Construction and more particularly pertains to a cylinder construction which defeats the use of tensioning devices.

2. Description of the Prior Art

The use of locks of known designs and configurations are known in the prior art. More specifically, locks of known designs and configurations heretofore devised and utilized for the purpose of minimizing the possibility of opening locks without keys are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,414,348 to M. Falk discloses a pin-tumbler lock. U.S. Pat. No. 3,478,549 to E. L. Schlage discloses a pick resistant lock unit. U.S. Pat. No. 3,531,959 to E. Weber discloses a security attachment for cylinder lock. U.S. Pat. No. 4,103,526 to Surko, Jr. discloses a pin tumbler lock. U.S. Pat. No. 4,631,941 to Sjunnesson discloses a cylinder lock with permissible service entry. U.S. Pat. No. 4,953,375, to Tzou discloses an electronically self-latching cylinder lock. U.S. Pat. No. 5,361,614, to Metcalf discloses a pin-tumbler lock with retained key and method of operation thereof. U.S. Pat. No. 5,400,629 to Myers discloses an axial pin tumbler lock. U.S. Pat. No. 5,640,865 to Widen discloses a cylinder lock and key combination. Lastly, U.S. Pat. No. 5,475,997 to Chung discloses a lock assembly.

While these devices fulfill their respective, particular objectives and requirements, the aforementioned patents do not describe a Pick-Resistant Lock System and Method that allows abating the friction between lock pins and their supporting bores for thereby precluding the opening of the lock without a key.

In this respect, the Pick-Resistant Lock System and Method according to the present invention substantially departs from the conventional concepts and designs of the prior art, and in doing so provides an apparatus primarily developed for the purpose of abating the friction between lock pins and their supporting bores for thereby precluding the opening of the lock without a key.

Therefore, it can be appreciated that there exists a continuing need for a new and improved Pick-Resistant Lock System with Improve Cylinder Construction which can be used for defeating the using of tensioning devices. In this regard, the present invention substantially fulfills this need.

SUMMARY OF THE INVENTION

In view of the foregoing disadvantages inherent in the known types of locks of known designs and configurations now present in the prior art, the present invention provides an improved Pick-Resistant Lock System and Method. As such, the general purpose of the present invention, which will be described subsequently in greater detail, is to provide a new and improved Pick-Resistant Lock System and Method and method which has all the advantages of the prior art and none of the disadvantages.

To attain this, the present invention essentially comprises a pick resistant lock system for use within a housing having an interior end and an exterior end with an axial cylindrical bore and a plurality of radial bores spaced along the cylindrical bore and constituting a pin chamber, the radial bores having opened ends in communication with the axial bore. The system comprises a main cylinder having interior and exterior ends and a length there between. The main cylinder has radial bores alignable with the radial bores of the housing and a planar key way alignable with the radial bores of the housing when in the locked orientation. A pair of opposed flat regions run the length of the cylinder and are formed opposite the radial bores. A cylindrical casing is fitted about the main cylinder, with the casing having apertures aligned with the radial bores of the main cylinder. The casing further includes a slot running the length of the cylinder. The slot is oriented intermediate the opposed flat regions. The main cylinder and casing are rotatably secured within the axial cylindrical bore of the housing. A facing cylinder is included which has an interior end and an exterior end. The facing cylinder is rotatably secured within the bore of the housing such that the facing cylinder is axially aligned with the main cylinder. The facing cylinder also has an introductory key way alignable with the key way of the main cylinder for receiving a key.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cylinder construction for use in a lock, whereby increased pick resistance is achieved.

It is another object of the present invention to provide a pick resistant system which can be readily retrofitted into an existing door.

It is further object of the present invention to provide a new and improved lock which cannot be picked either by traditional tools, screw drivers, or drills.

An even further object of the present invention is to provide a new and improved Pick-Resistant Lock System which is susceptible of a low cost of manufacture with regard to both materials and labor, and which accordingly is then susceptible of low prices of sale to the consuming public, thereby making such Pick-Resistant Lock System and Method economically available to the buying public.

Even still another object of the present invention is to provide a system whereby a tensioning tool is given no room in which to work.

Lastly, it is an object of the present invention to provide a new and improved pick resistant lock system comprising a pick resistant lock system which includes a main cylinder having interior and exterior ends and a length there between. The main cylinder has radial bores and a planar key way, and a pair of opposed flat regions running the length of the cylinder formed opposite the radial bores. A facing cylinder is included which has an interior end and an exterior end in facing relation and axially aligned with the main cylinder. The facing cylinder also has an introductory key way alignable with the key way of the main cylinder for receiving a key.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view similar to FIG. 2 but illustrating the tension bar within the lock being rotated to preclude the picking of the lock.

FIG. 4 is a cross-sectional view taken along line 4—4 of FIG. 1.

FIG. 5 is an exploded perspective view of the system shown in the prior Figures.

FIG. 6 illustrates an alternate embodiment of the present invention.

FIG. 10 is an exploded view of the embodiment depicted in FIGS. 7 and 8.

FIG. 11 is an exploded view illustrating a backing plate.

FIG. 12 is an elevational view of the pick resistant lock system employing the improved cylinder construction of the present invention.

FIG. 13 is a side sectional view of the improved cylinder construction.

FIG. 16 is a front elevational view of the improved cylinder construction depicted in FIG. 14.

FIG. 17 is a front elevational view of an additional cylinder construction of the present invention.

FIG. 18 is a front elevational view of an additional cylinder construction of the present invention.

The same reference numerals refer to the same parts through the various Figures.

DESCRIPTION OF THE PREFERRED EMBODIMENT

Figure 1:
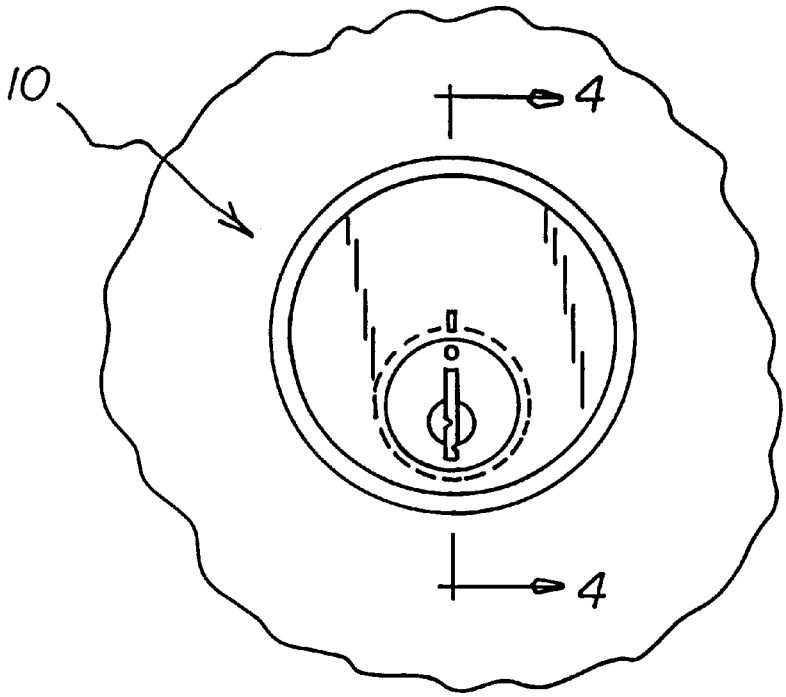
FIG. 1 is a front elevational view of the new and improved Pick-Resistant Lock System constructed in accordance with the principles of the present invention.
Figure 2:
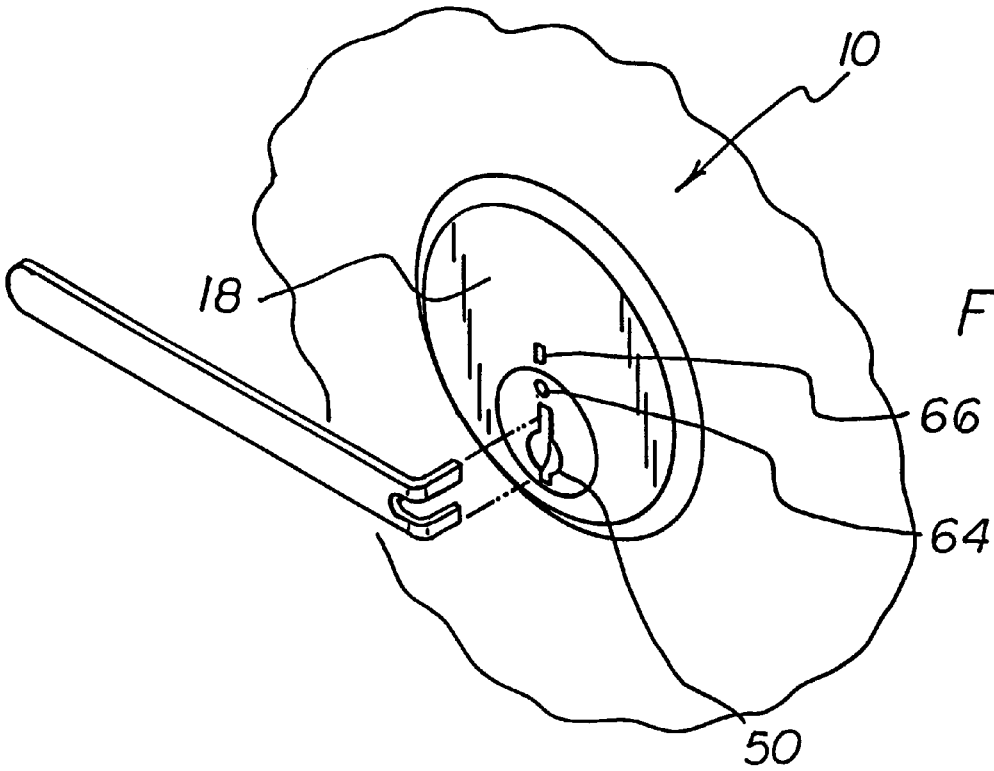
FIG. 2 is a perspective view of the apparatus as shown in FIG. 1 illustrating a lock tension bar which might otherwise be used for picking the lock.

With reference now to the drawings, and in particular to FIG. 1 thereof, the preferred embodiment of the new and improved Pick-Resistant Lock System and Method embodying the principles and concepts of the present invention and generally designated by the reference numeral 10 will be described.

Primary Embodiment

The present invention relates to a new and improved pick-resistant lock system (10) which functions for abating the friction between lock pins and their supporting bores. This precludes the opening of the lock without a key comprising, in combination:

The central component of the system is an essentially cylindrical housing (14) having an interior end (16) and an exterior end (18). It also has an axial cylindrical bore (20) and a plurality of radial bores (22). The radial bores are spaced along the cylindrical bore and constitute a pin chamber. In addition, the radial bores have open ends (24) in communication with the axial bore.

A rotatable main cylinder (28) is next provided. The main cylinder has both an interior face and an exterior face. Such cylinder is rotatably located within the axial bore. The main cylinder has radial bores (30). The bores are alignable with the radial bores of the housing. Further, a planar key way (32) is provided to be alignable with the radial bores when in the locked orientation.

Next provided are a plurality of pins (36) formed of plural segments (38). The segments are positionable within the radial bores of the housing and main cylinder and have springs (40) urging the pins toward the key way. The segments of the pins have interfaces which are alignable with the interface between the bores of the main cylinder and housing.

Next provided is a generally cylindrical facing cylinder (44). The facing cylinder has both an interior face and an exterior face. The cylinder is axially alignable with the main cylinder and freely rotatable with respect thereto. The facing cylinder has an annular enlargement (46) matable with a complementary recess (48) in the is main cylinder. The facing cylinder also has an introductory key way (50). This key way is alignable with the key way of the main cylinder for receiving a key. Preferably, the interior faces of the facing and main cylinder are flush with one another.

Next provided is a cam (54) secured to the face of the main cylinder remote from the facing cylinder for effecting the unlocking of the lock upon rotation of the cylinder and cam by rotation of a key.

Next provided is a key (58) having an edge with undulations (60) adapted to enter the key ways when the key ways are aligned to selectively move the pins away from the key to an unlocking orientation with the interfaces of the pins aligned with the interfaces of the main cylinder and housing.

Alignment marks (64, 66) on the faces of the main cylinder and facing cylinder indicate the alignment of the key ways whereby rotation of the facing cylinder as by a tension bar will not effect the rotation of the main cylinder. The creation of friction forces between the pins and the bores are thereby precluded which would otherwise allow a pick to raise the pins and allow the opening of the lock without a key.

An alternate embodiment of the invention is shown in FIG. 5. In such embodiment, the enlargement (70) is annular and located at the end of the cylinder adjacent to the main cylinder. Note the dotted line showing of FIG. 5.

Method of Abating Friction Between Lock Pins and Bores

The invention also includes a pick-resistant lock method for abating the friction between lock pins and their supporting bores. This again is for precluding the opening of the lock without a key comprising, in combination:

The first step is providing an essentially cylindrical housing (14) having an interior end (16) and an exterior end (18) with an axial cylindrical bore (20) and a plurality of radial bores (22) spaced along the cylindrical bore and constituting a pin chamber, the radial bores having open ends (24) in communication with the axial bore.

The second step is providing a rotatable main cylinder (28) rotatably located within the axial bore, the main cylinder having radial bores (30) alignable with the radial bores of the housing and a planar key way (32) alignable with the radial bores when in the locked orientation.

The third step is providing a plurality of pins (36) formed of plural segments (38) positionable within the radial bores of the housing and main cylinder and with springs (40) urging the pins toward the key way, the segments of the pins having interfaces which are alignable with the interface between the bores of the main cylinder and housing;

The fourth step is providing a cam (54) secured to the face of the main cylinder remote from the facing cylinder for effecting the unlocking of the lock upon rotation of the cylinder and cam by rotation of a key;

The fifth step is providing a key (58) having an edge with undulations (60) adapted to enter the key ways when the key ways are aligned to selectively move the pins away from the key to an unlocking orientation with the interfaces of the pins aligned with the interfaces of the main cylinder and housing.

The sixth step is providing alignment marks (64, 66) on the faces of the main cylinder and facing cylinder to indicate the alignment of the key ways whereby rotation of the facing cylinder as by a tension bar will not effect the rotation of the main cylinder to thereby preclude the creation of friction forces between the pins and the bores which would otherwise allow a pick to raise the pins and allow the opening of the lock without a key.

The final step is abating the friction forces between the pins and their supporting bores whereby moving the pins as by a pick will preclude the retention of the pins in an unlocking orientation against the action of the springs.

In one embodiment, the final step is effected by a generally cylindrical facing cylinder (44) axially alignable with the main cylinder and freely rotatable with respect thereto, the facing cylinder having an enlargement (46) matable with a complementary recess (48) in the main cylinder, the facing cylinder also having an introductory key way (50) alignable with the key way of the main cylinder for receiving a key.

Lubricating Fluid

In an alternate embodiment, the final step is effected by a lubricating fluid injected into the lock to coat the interfaces between the pins and their bores.

In the alternate embodiment, the lubricating fluid, preferably includes an aliphatic hydrocarbon, a water-displacing compound, a lubricant (60), a fragrance, and a propellant, the lubricant being poly tetrafluoroethylene, the lubricant constituting at least 50 percent by weight of the content of the lubricating fluid.

The present lubricating fluid will make any pin-tumbler cylinder lock virtually impossible to pick pin-tumbler cylinder locks are the most widely used style of lock for security in residential and commercial buildings at the present time. The present lubricating fluid is a superior lubricating substance. It will protect the moving parts inside the lock cylinder. It will enhance the lifetime of the lock and help insure that the lock works efficiently as it was intended with the proper key. By inserting the present lubricating fluid into the lock cylinder through the opening made for the key and then gently massaging it in the cylinder so that it coats all moving parts, the lock now becomes virtually impossible to pick.

The present lubricating fluid works in the following fashion. In order to pick a lock a tension bar and a pick must be used. The right amount of pressure must then be applied on the cylinder core with a tension tool. Then, a pick must be used to move each individual pin up to the shear line in the cylinder. When all the pins have reached the shear line, the lock will open.

The present lubricating fluid will prevent the tension bar and pick from operating properly. The present lubricating fluid will not allow the pins to remain at the proper level with the shear line, therefore the lock will not open without the proper key.

The above is accomplished because the ingredients in the present lubricating fluid coat all parts inside the lock cylinder making these parts too slippery to be manipulated properly with a tension bar and lock pick. Only the proper key made for the specific lock will place the pins at the proper position, therefore opening the lock.

Alignment Means

Additional embodiments of the pick resistant lock system employ means to keep the introductory key way in temporary alignment with the key way of the main cylinder. In this manner, a user need not adjust the facing cylinder before insertion of the key. However, any tampering, whether by traditional pick tools or other tools such as a screwdriver, will cause the facing cylinder to rotate out of alignment with the main cylinder.

Figure 7:
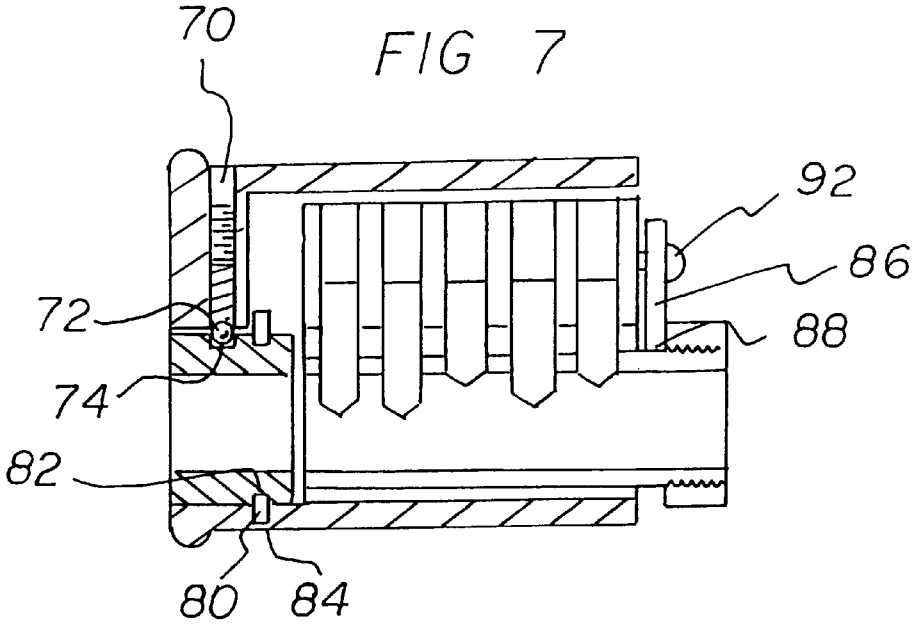
FIG. 7 is a cross-sectional view of an embodiment employing a spring biased detent.

One of the alignment means takes the form of a detent and is illustrated in FIG. 7. In this embodiment, a detent bore 70 is formed proximate to the interior end of the main housing. A spring biased bearing 72 is positioned within the detent bore 70. A screw can thereafter be used to seal the bearing and associated spring. The bearing 72 is adapted to engage a semispherical indentation or detent 74 formed within an exterior surface of the facing cylinder. When the spring biased bearing 72 lockingly engages the semispherical detent 74 the facing cylinder is properly aligned with the main cylinder. Namely, the key way of the main and facing cylinders are aligned to accept a key. Any rotational motion imparted to the facing cylinder overcomes the force of the spring biased bearing 72. In this manner, the facing cylinder is be rotated out of alignment with the main cylinder when tampering occurs.

Figure 8:
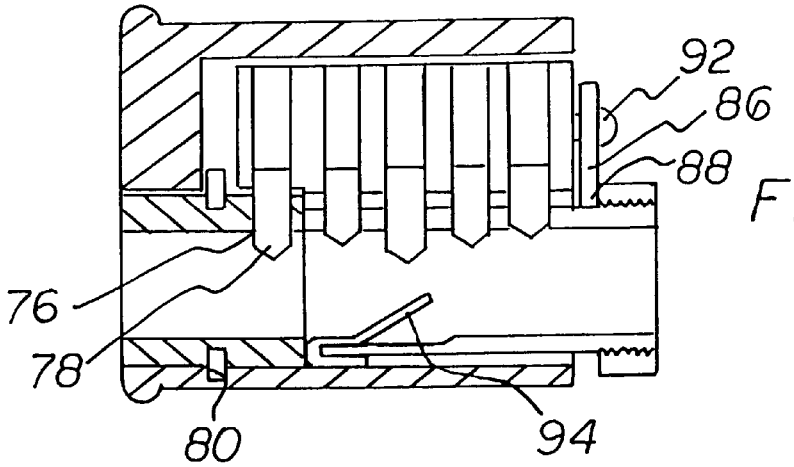
FIG. 8 is a cross-sectional view of an embodiment wherein one of the pins extends through the facing cylinder.

An additional alignment means is depicted with reference to FIG. 8. This Figure illustrates a cylindrical bore 76 formed proximate to the exterior end of the facing cylinder. The cylindrical bore 76 of the facing cylinder is adapted to accept an alignment pin 78. As with the other pins, the alignment pin 78 of the facing cylinder bore is formed of plural segments which are positionable within one of the radial bores of the housing. Furthermore, the alignment pin includes a spring which urges the pin through the bore of the facing cylinder and into the introductory key way. The segments of the pin having an interface which is alignable with the interface between the bore of the facing cylinder and housing. Thus, with the alignment pin positioned within the bore 76 of the facing cylinder, the introductory key way is properly aligned with the key way of the main cylinder. Alternatively, when the alignment pin is forced upward within the bore of the main housing, the facing cylinder is permitted to rotate relative to the main cylinder. Thus, a thief picking the lock would be able to "pick" only the first pin. Thereafter, the other pins could not be picked as no tension could be transferred into the remainder of the main cylinder.

Figure 9:
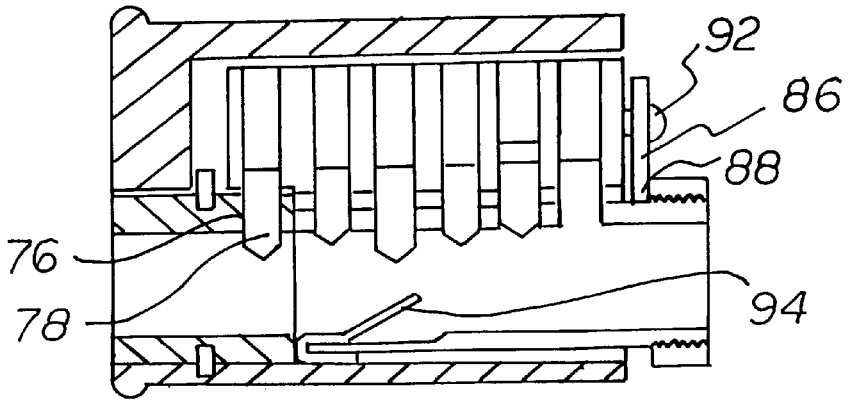
FIG. 9 is a cross-sectional view of an embodiment similar to that illustrated in FIG. 8, but employing six pins.

Either of the above described embodiments can be employed in conjunction with a six pin embodiment, note FIG. 9. Additionally, any of the embodiments previously described could employ a snap ring 80 to interconnect the facing cylinder and the main cylinder. Such interconnection is achieved by a groove formed 82 within the periphery of the facing cylinder proximate to the exterior face. Furthermore, a similar groove 84 is formed within the cylindrical bore of the main housing proximate to the interior end. The snap ring 80 is adapted to be removably secured within the groove 82 of the facing cylinder and within the groove 84 of the cylindrical housing. In this manner, the snap ring 80 rotatably couples the facing cylinder within the bore of the main housing.

All of the above described embodiments can also be employed in conjunction with a backing plate 86. The backing plate 86 is secured within a channel 88 formed proximate the exterior end of the main cylinder. Additionally, the backing plate 86 is also secured to the exterior end of the main housing, preferably by way of a screw 92. In this manner, the backing plate 86 precludes the main cylinder from being removed from the cylindrical housing.

FIG. 8 illustrates a ramp 94 which can be employed in conjunction with any of the embodiments of the present invention. The ramp 94 is preferably spring biased and positioned within the key way opposite the radial bores of the main cylinder. In the preferred embodiment, the ramp 94 is secured within the main cylinder. However, it is within the scope of the present invention to secure the ramp 94 within the key way of the facing cylinder. In either location, the spring biased ramp 94 functions to preclude a tension bar from being positioned along the key way. Namely, a tension bar inserted along the key way is urged upward due to the spring biased ramp. Thus, no rotational motion can be imparted to the main cylinder. All of the tamper resistant features heretofore described enable the lock to be pick proof, whether traditional burglar tools are being employed or other devices such as screwdrivers.

Pick-Resistant Lock System with Improved Cylinder Construction

The next embodiments of the present invention are depicted with reference to FIGS. 12–19. These embodiments utilize an improved cylinder construction to frustrate the use of lock picking tools, such as a tensioning device. Specifically, a pair of opposing flat regions are formed at the lower end of the cylinder. Furthermore, the key way formed within the cylinder has an opened lower end. As will be explained hereinafter, these features make a system which is completely resistant to picking, either by way of traditional pick tools, or other tools such as screwdrivers and drills. The various features of these embodiments will be described in greater detail hereinafter.

With reference to FIGS. 12 and 13 the housing in which the system is employed will be described. Such housing is defined by an interior end and an exterior end with an axial cylindrical bore connecting these two ends. Furthermore, a plurality of radial bores are spaced along the cylindrical bore and constitute a pin chamber. These radial bores have opened ends which are in communication with the axial bore.

Figure 14:
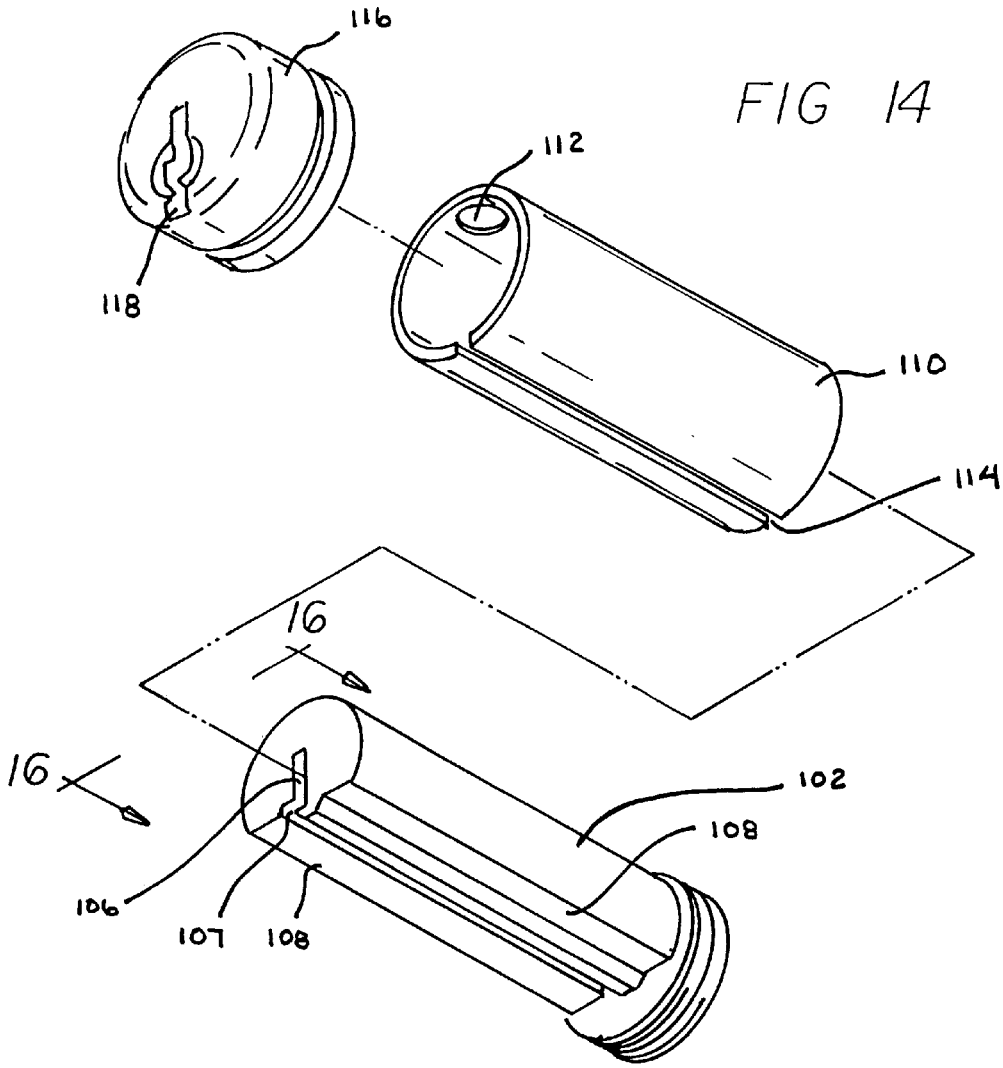
FIG. 14 is an exploded view of the pick resistant lock system utilizing the improved cylinder construction.
Figure 15:
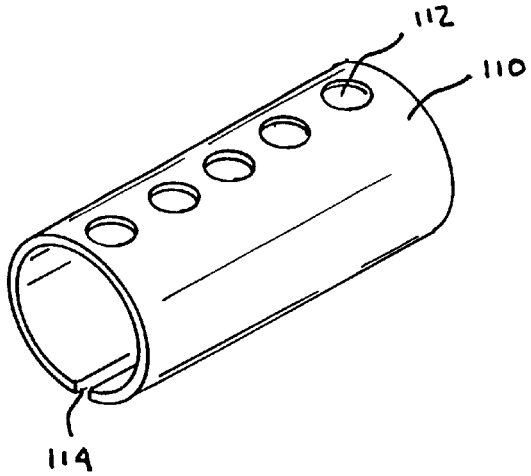
FIG. 15 is a view of the cylindrical casing employed in the system of FIG. 14.

The system of the present invention has three major components: a facing cylinder; a cylindrical casing; and a main cylinder (or pin cylinder). With reference now to FIG. 14, the main cylinder 102 is defined by interior and exterior ends and a length there between. The main cylinder 102 further includes a series of bores 104 which extend radially into the center of the cylinder 102. These bores 104 are alignable with the radial bores of the housing to allow the pins of the housing to extend into the interior of the cylinder 102. Such an orientation represents a locked condition.

With continuing reference to FIG. 14, a planar key way 106 is also formed within the main cylinder 102. The cylinder shape 102 is altered by removing the lower portion of the cylinder 102. This construction results in the creation of the flat regions 108. The key way 106 is alignable with the radial bores of the housing when the system 100 is in the locked orientation. Finally, a pair of opposed flat regions 108 runs the length of the cylinder 102 and are formed opposite the radial bores 104. The opened key way 107, in combination with the flat regions 108, combine to create the increased pick resistant features of the lock.

In the preferred embodiment, a cylindrical casing 110 is fitted about the main cylinder 102 by way of a press fitting. The press fitting permits the cylinder 102 and casing 110 to rotate as a single unit within the axial cylindrical bore of the housing. Additionally, the press fitting enables the system of the present invention to be easily retrofitted into an existing lock assembly. Furthermore, the casing 110 preferably has the dimensions of a conventional cylinder. The casing 110 further includes apertures 112 that are aligned with the radial bores of the main cylinder 102. These apertures 112 allow the pins of the housing to extend downwardly into the cylinder 102 when the bores 104 of the cylinder 102 are properly aligned with the housing. Conversely, the casing 110 keeps the pins in their retracted orientation during rotation of the cylinder 102. Without the casing, the pins might otherwise be improperly extended when the flat regions 108 of the cylinder were rotated under the pins.

The casing 110 is further defined by a slot 114 formed within the lower extent of the casing 110. Such slot 114 runs the length of the casing 110. As is illustrated in FIG. 14, the slot 114 is oriented intermediate the opposed flat regions 108. With reference now to FIG. 16, it can be appreciated that a void area 115 is created between the flats 108 of the cylinder and the inner surface of the casing 110. The function of this void area 115 will be described in greater detail hereinafter.

The final component of the system is the facing cylinder 116. The facing cylinder 116 is defined by interior and exterior ends. The facing cylinder 116 is rotatably secured within the bore of the housing such that it is axially aligned with the main cylinder 102 and in facing relation thereto.

The facing cylinder 116 also has an introductory key way 118 alignable with the key way 106 of the main cylinder 102 for receiving a key.

The system of the present invention achieves its pick resistance by virtue of the flats 108 formed within the main cylinder 102. The opened key way 107 prohibits any tensioning type device from contacting the bottom portion of the main cylinder. As a result, no tension or rotation can be applied to the cylinder 102. Consequently, a thief will not be able to secure individual pins at the shear line during picking operations. Moreover, rotation will be limited by the flats 108 when a tensioning tool is inserted within the main cylinder 102. Alternatively, if a tool is inserted only into the facing cylinder, only the facing cylinder will rotate. As best illustrated in FIG. 12, certain tensioning tool will only be able to rotate the facing cylinder about 30 degrees. After 30 degrees of rotation, the tool with contact the flat 108 of the main cylinder 102. Furthermore, with the facing cylinder rotated a tool will not be able to access any of the pins.

FIGS. 17 and 18 illustrate different main cylinder geometries. In FIG. 17, the flat regions of the main cylinder are not level with one another. Consequently, rotation of the facing cylinder will be limited more on the lower side of the flat. Conversely, FIG. 18 illustrates an embodiment wherein the flat regions are level with one another. These geometries produce differing void spaces 115. It is the geometry of the void space 115 which dictates how many degrees the facing cylinder can be rotated.

Figure 19:
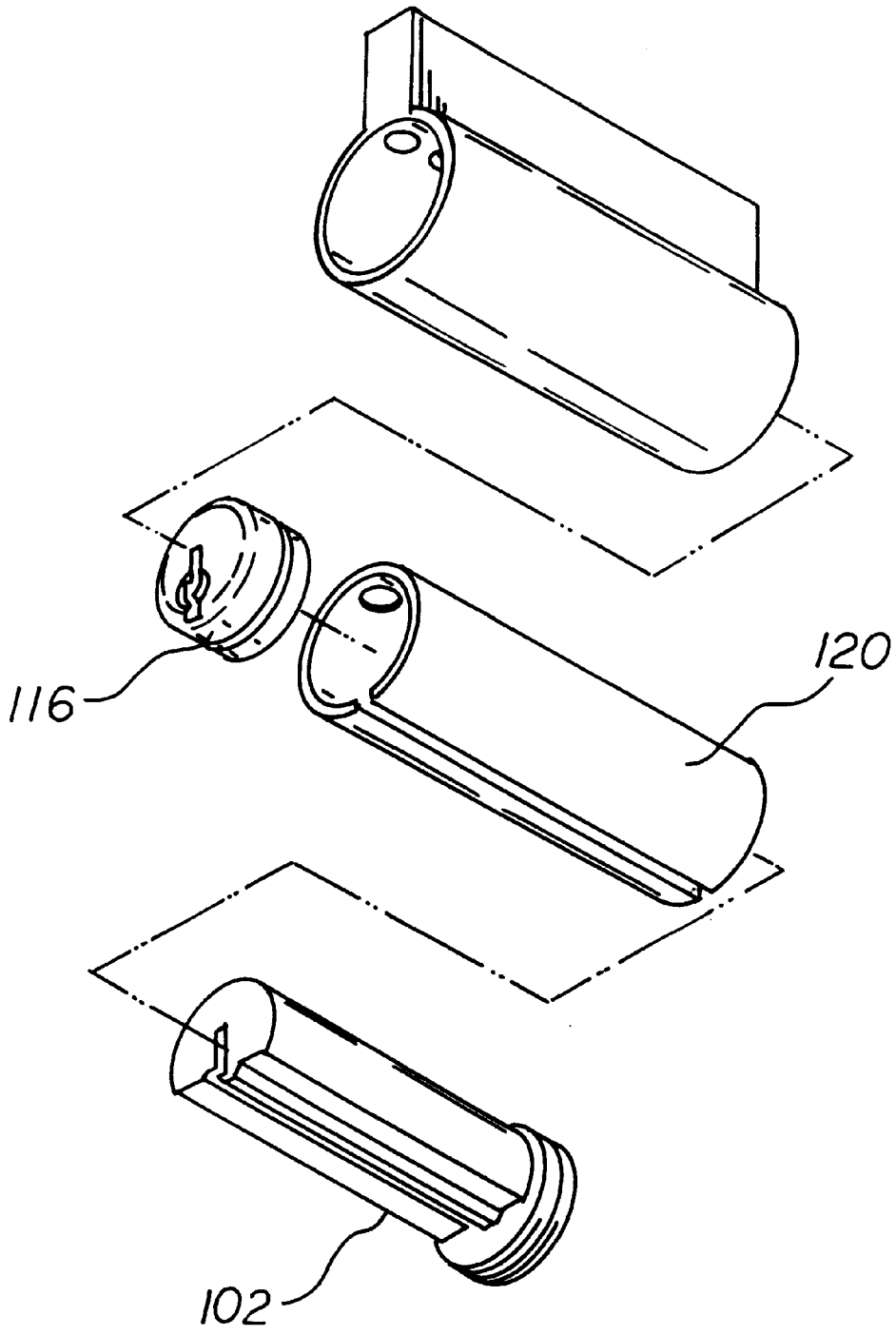
FIG. 19 is a secondary embodiment of the pick resistant lock system utilizing an improved cylindrical construction.

With reference now to FIG. 19, an alternative embodiment of the present invention is depicted. This embodiment is the same in most respects to the embodiment of FIG. 14. However, the casing 120 in FIG. 19 is elongated and covers the facing cylinder 116. In this manner, the facing cylinder 116 is rotatably positioned within the casing 120. In this manner, the facing cylinder can rotate with respect to the main cylinder and casing. As a consequence, the facing cylinder, casing, and main cylinder can be positioned within the housing as a common unit. This embodiment permits the system of the present invention to be readily retrofitted into an existing lock housing, much like earlier embodiments.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pick resistant lock system for use within a housing having an interior end and an exterior end with an axial cylindrical bore and a plurality of radial bores spaced along the cylindrical bore and constituting a pin chamber, the radial bores having opened ends in communication with the axial bore, the system comprising in combination:

a main cylinder having interior and exterior ends and a length there between, the main cylinder having radial bores alignable with the radial bores of the housing, a planar key way alignable with the radial bores of the housing when in the locked orientation, a pair of opposed flat regions running the length of the cylinder formed opposite the radial bores;

a cylindrical casing being fitted about the main cylinder, the casing having apertures aligned with the radial bores of the main cylinder, the casing further including a slot running the length of the cylinder, the slot being oriented intermediate the opposed flat regions, the main cylinder and casing being rotatably secured within the axial cylindrical bore of the housing;

a facing cylinder having an interior end and an exterior end the facing cylinder being rotatably secured within the bore of the housing such that the facing cylinder is axially aligned with the main cylinder, the facing cylinder also having an introductory key way alignable with the key way of the main cylinder for receiving a key.

2. A pick resistant lock system comprising in combination:

a main cylinder having interior and exterior ends and a length there between, the main cylinder having radial bores and a planar key way, a pair of opposed flat regions running the length of the cylinder formed opposite the radial bores;

a facing cylinder having an interior end and an exterior end in facing relation and axially aligned with the main cylinder, the facing cylinder also having an introductory key way alignable with the key way of the main cylinder for receiving a key.

3. The system as described in claim 2 further comprising:

a cylindrical casing being fitted about the main cylinder, the casing having apertures aligned with the radial bores of the main cylinder, the casing further including a slot running the length of the cylinder, the slot being oriented intermediate the opposed flat regions.

4. The system as described in claim 3 wherein the opposed flat regions of the main cylinder are level with one another.

5. The system as described in claim 3 wherein the opposed flat regions of the main cylinder are not level with one another.

6. The system as described in claim 3 wherein the facing cylinder is rotatably positioned within the cylindrical casing.

* * * * *